US005249997A

United States Patent [19]

Nance

[11] Patent Number: 5,249,997

[45] Date of Patent: Oct. 5, 1993

[54] COMPOSITE MULTISECTION BUOYANT STRUCTURE

[75] Inventor: Donald A. Nance, Los Altos, Calif.

[73] Assignee: Westinghouse Electric Corp., Pittsburgh, Pa.

[21] Appl. No.: 858,462

[22] Filed: Mar. 27, 1992

[51] Int. Cl.[5] ..... B63B 22/00; B63B 3/06

[52] U.S. Cl. ..... 441/1; 114/65 R; 114/341

[58] Field of Search ..... 441/1, 3, 21, 23; 114/65 R, 65 A, 341, 77 R, 77 A, 357; 220/565, 567, 412; 244/120; 52/249, 785, 808

[56] References Cited

U.S. PATENT DOCUMENTS

| | | | |
|---|---|---|---|
| 3,072,225 | 1/1963 | Cremer et al. | 52/249 |
| 3,166,212 | 1/1965 | Resos | 220/412 X |
| 3,329,297 | 7/1967 | Jordan | 114/341 |
| 3,383,004 | 5/1968 | Closner | 220/565 X |
| 3,490,638 | 1/1970 | Elliott et al. | 220/4.12 |
| 3,598,275 | 8/1971 | Francois | 114/341 X |
| 3,608,767 | 9/1971 | Elliott et al. | 220/4.12 |

FOREIGN PATENT DOCUMENTS

| | | | |
|---|---|---|---|
| 0748395 | 5/1956 | United Kingdom | 114/357 |

*Primary Examiner*—Sherman Basinger
*Attorney, Agent, or Firm*—D. Schron

[57] ABSTRACT

An underwater, high strength lightweight buoyant structure fabricated of individual segments which are adhesively bonded together. Each segment includes an outer wall which faces the ambient medium, an inner wall displaced from the outer wall and a plurality of tapered side walls joining the outer and inner walls thereby defining a central core. The walls are of composite construction and the arrangement is such as to eliminate local buckling and collapse when utilized at great ocean depths, without the use of thick composite sections.

15 Claims, 7 Drawing Sheets

COMPOSITE MULTISECTION BUOYANT STRUCTURE

BACKGROUND OF THE INVENTION

1. Field of the Invention

The invention in general relates to buoyant structures, and particularly to a structure formed of a composite material.

2. Background Information

Buoyancy devices are utilized in the water environment for a variety of tasks, and at ocean depths measurable in hundreds or thousands of feet. Such devices are large, generally spherical structures requiring thick wall sections to withstand the external pressure and to eliminate local buckling problems caused by such pressure.

Such buoyant structures are typically fabricated from metal and may be tens of feet in diameter. The cost of fabricating such structures, utilizing metal, may be uneconomical, and in addition, the structures are excessively heavy to handle when out of the water environment.

The present invention provides for a relatively lightweight, low cost buoyant structure which may be used for a variety of tasks in the underwater environment.

SUMMARY OF THE INVENTION

A composite multisection positively buoyant structure is provided which is fabricated from a plurality of individual segments. Each segment includes an outer wall, an inner wall spaced from the outer wall, and tapered side walls joining the outer and inner walls so as to define a central core within the segment. The outer and inner walls are composite structures which include first and second opposed face members separated by a filler material preferably of a honeycomb configuration. If desired, the tapered side walls may also be of such construction. Means such as an adhesive is provided to bond the tapered side walls of the individual segments together in a predetermined geometric pattern to form the buoyant structure. In one embodiment, the individual segments are so shaped so as to form a spherical structure. When utilized as an underwater buoyancy device, attachment means are included as part of the structure.

In another embodiment, the individual segments are elongated and bonded together to form a cylindrical structure which may then have hemispherical end caps attached so as to form an underwater structure which may be utilized as a submersible.

In order to protect the surface of the structure from the ambient medium, a protective coating may be placed on the outside surface of the structure.

DESCRIPTION OF THE PREFERRED EMBODIMENTS

Figure 1:
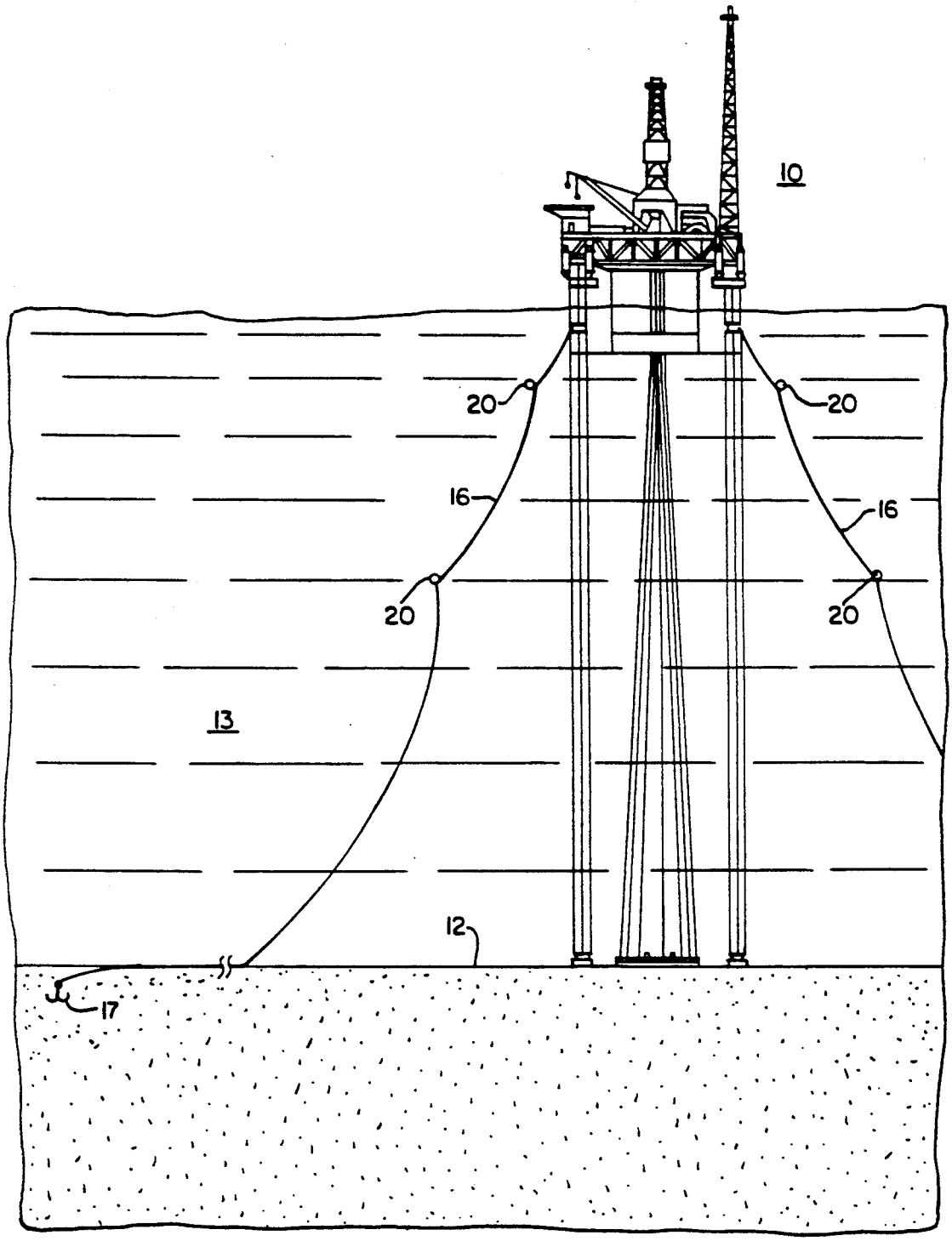
FIG. 1 is a view of an underwater environment in which the present invention finds application.

In FIG. 1, there is illustrated, by way of example, an off-shore oil platform 10 which is moored to the bottom 12 of a body of water 13. The mooring system includes mooring lines 16 each connected to a respective anchor 17 embedded in the bottom 12.

The mooring lines 16 are constituted by a combination of large diameter spiral strand wire and chain, the total weight of which contributes to a significant downward force on the platform 10, particularly when a plurality of such mooring lines are utilized. In order to counteract this downward force, positively buoyant structures in the form of buoys 20 are attached to the mooring line 16, as illustrated. In addition to reducing the downward force on the platform 10, the buoy arrangement also acts as an energy absorber by damping the vertical forces encountered in the water environment.

Figure 2:
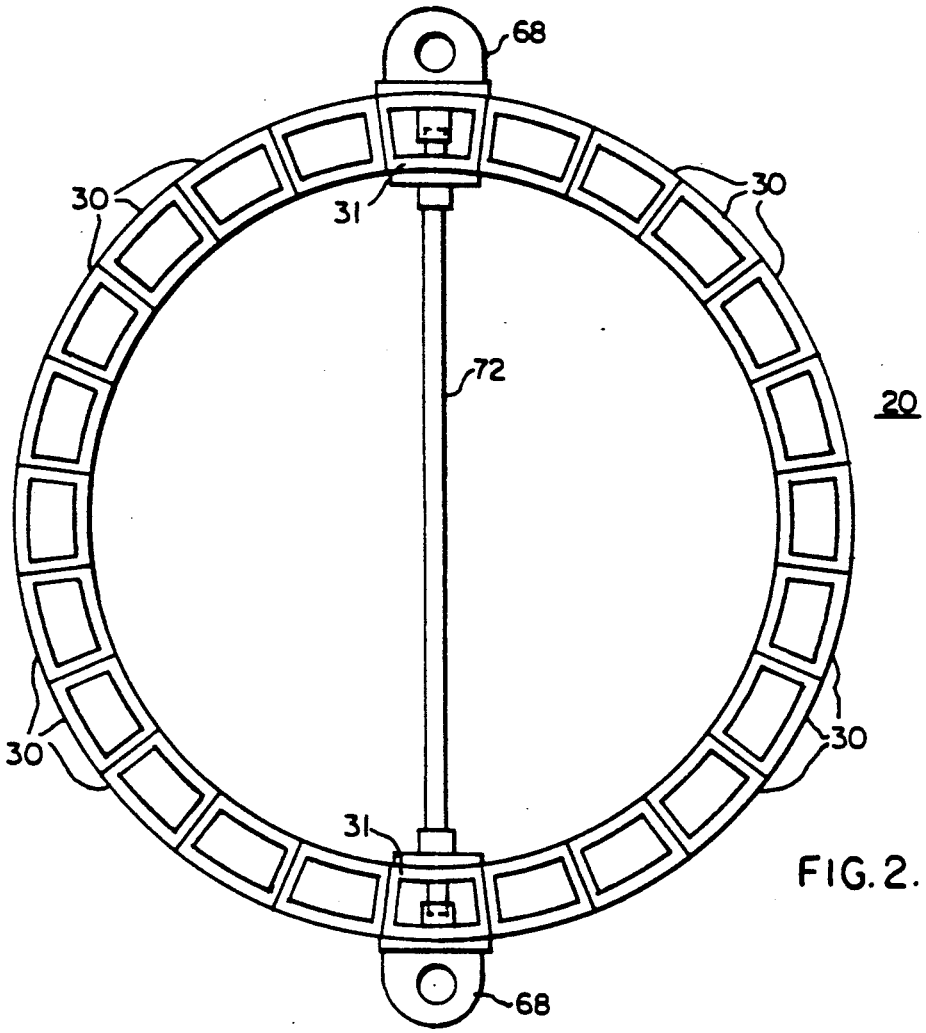
FIG. 2 is a sectional view through selected segments of a structure fabricated in accordance with the present invention.

The buoys, which are massive structures tens of feet in diameter, may be fabricated in accordance with the present invention, one example of which is illustrated in FIG. 2.

Figure 3:
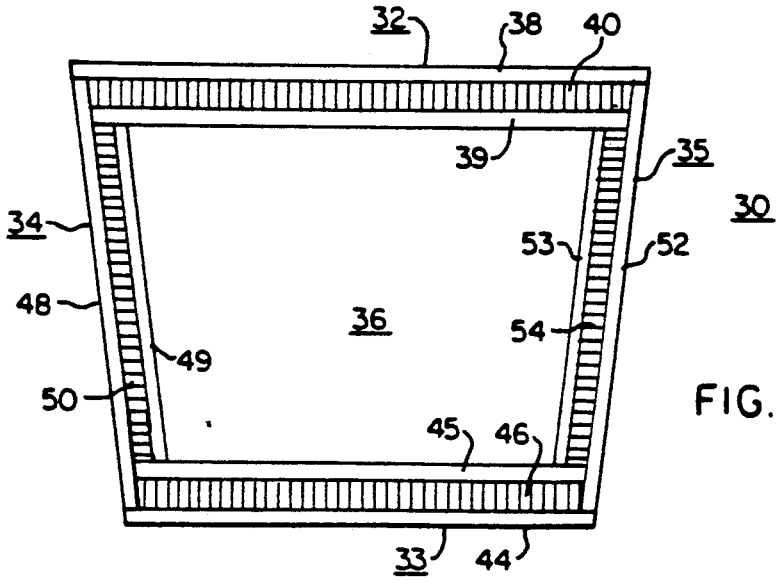
FIG. 3 is a sectional view of one segment of the structure of FIG. 2.

The buoy 20 is generally in the shape of a sphere made up of a plurality of adjacent and mating segments 30, as well as two keystone segments 31. With additional reference to FIG. 3, there is illustrated a cross-sectional view of a typical segment 30. Segment 30 includes an outer wall 32, an inner wall 33 and a plurality of tapered side walls of which two, 34 and 35 are shown and which join in the outer and inner walls 32 and 33 thereby defining a central core 36.

The outer and inner walls are preferably of a composite construction and include by way of example, for the outer wall 32, first and second opposed face members 38 and 39 separated by a filler material 40 which, to add strength with reduced weight may be of a honeycomb construction.

Inner wall 33 is similar to outer wall 32 and includes opposed face members 44 and 45 separated by a filler material 46. Tapered side walls 34 and 35 may also be of composite construction to include, for wall 34, first and second opposed face members 48 and 49 separated by filler material 50, and for tapered wall 35, first and second face members 52 and 53 separated by filler material 54. All of the face members may be fabricated from sheets of metal or non-metal material or may themselves be a composite material such as glass or graphite fibers within a host matrix such as epoxy resin.

The construction of the segment is such that the inner wall 33 is at a substantial distance from the outer wall 32 resulting in a significant increase in the cross-section bending stiffness of the unit thereby eliminating the problem of local buckling and collapse when used at deep ocean depths.

Figure 4:
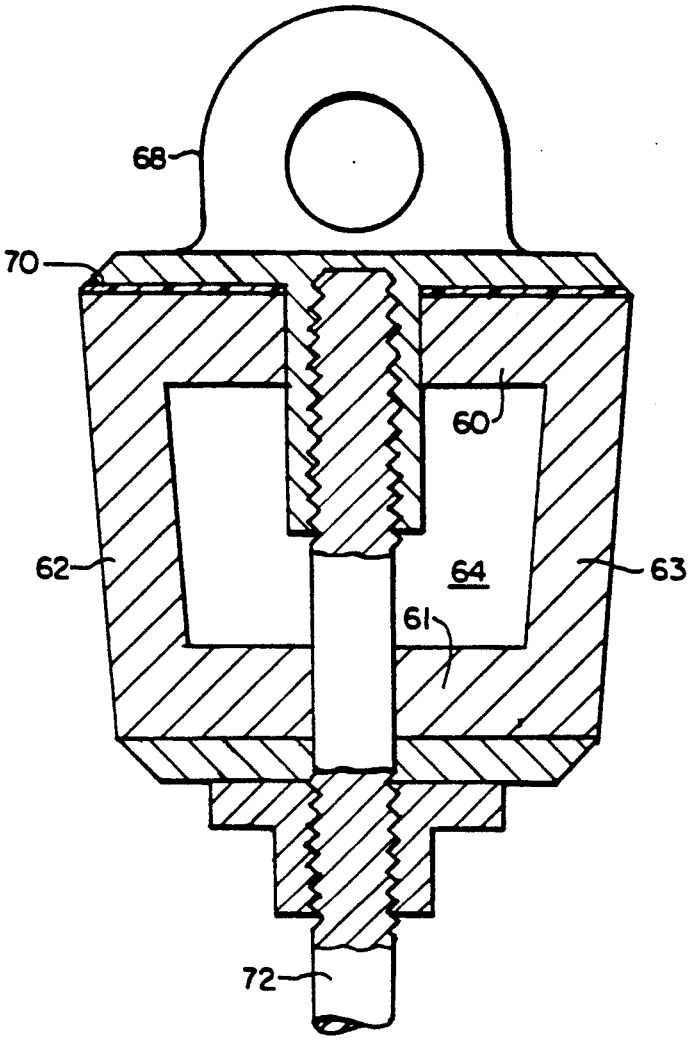
FIG. 4 illustrates the arrangement of a keystone segment for the structure of FIG. 2.

With additional reference to FIG. 4, there is illustrated a typical keystone segment 31. Although the keystone segment may be fabricated of a solid block of material, it is illustrated by way of example as including an outer wall 60, an inner wall 61, and tapered side walls of which two, 62 and 63, are illustrated, with the arrangement defining a central core 64. The walls may be fabricated of a solid metal or may be of a composite construction similar to segments 30.

An attachment means 68 is provided for handling purposes or for connection to a mooring line, for example, with the attachment means 68 being separated from the keystone segment by means of a sealing gasket 70. A metallic or composite rod 72 which may be threaded or epoxied to attachment means 68 is provided and is utilized to transmit the load to the opposite keystone segment end cap.

The outer and inner walls of each segment are polygons, the number of sides of which determine the number of tapered side walls. By way of example, FIG. 5 illustrates a hexagonal segment 74 having hexagonal outer and inner walls 75 and 76 joined by six tapering side walls 77 to 82.

Figure 6:
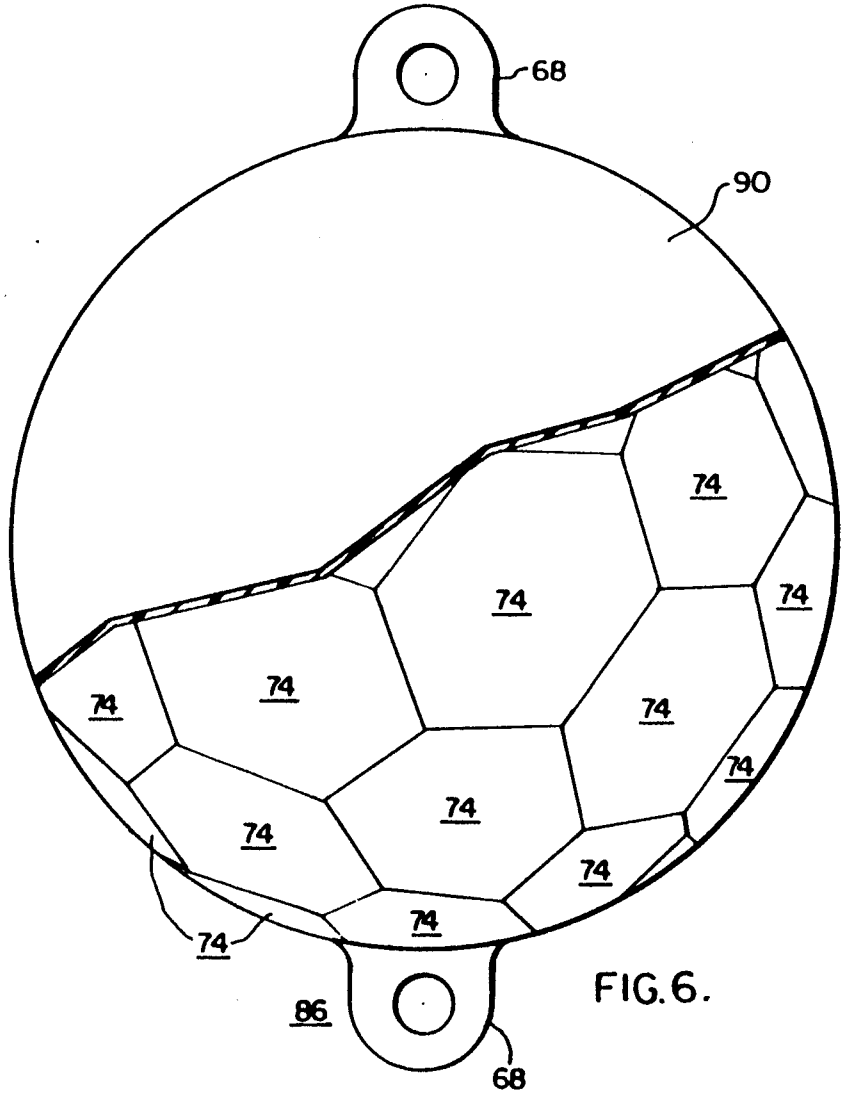
FIG. 6 is a view of a plurality of segments as in FIG. 5 joined together to form a spherical structure.

A bonding means such as an epoxy 84 (shown stippled) is placed on the outside surface of the tapered side walls and the segments are bonded together to form a generally spherical structure 86, as illustrated in FIG. 6. In this regard, the spherical structure 86 in reality has a multi-faceted surface which is entirely satisfactory for its intended purposes. If desired, however, the outer and inner walls, 75 and 76 of individual segments may be curved to conform to a more precise spherical surface.

Figure 7:
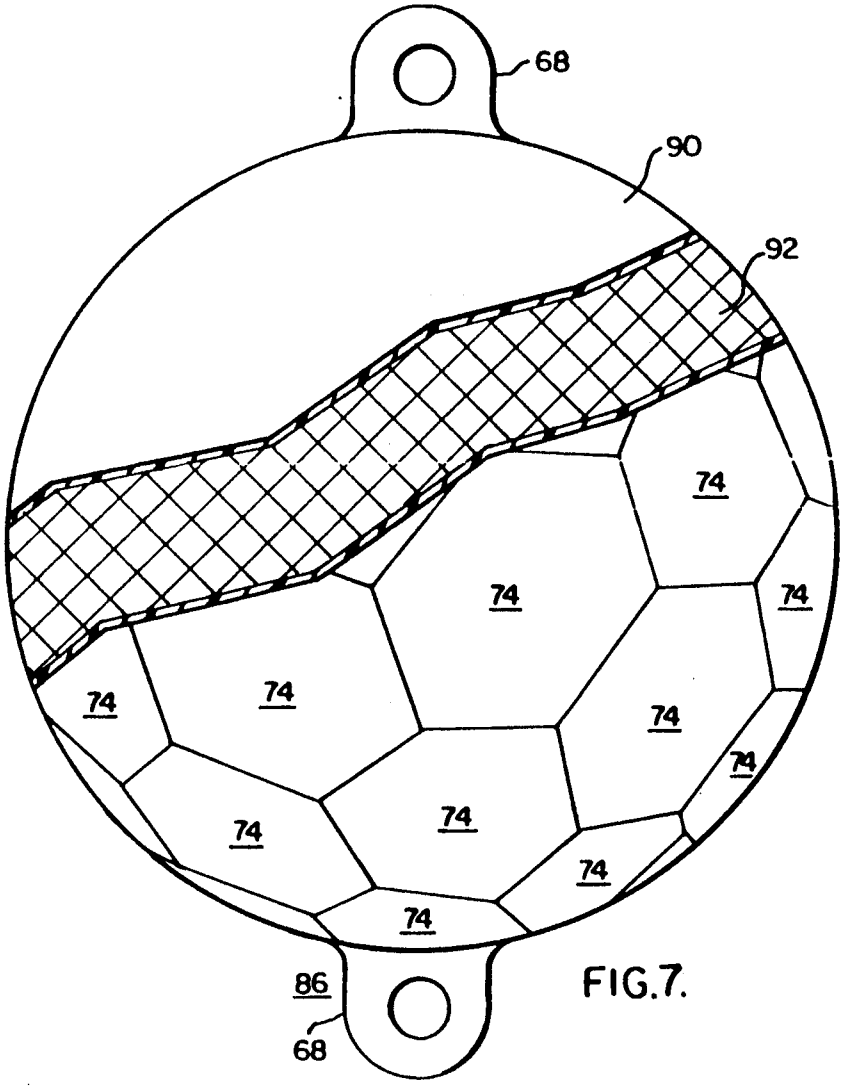
FIG. 7 illustrates a modification to the surface of the sphere formed by the segments of FIG. 5.

Once the spherical structure 86 has been assembled and the bonding epoxy cured, the structure may be provided with a protective waterproof membrane 90 on its outer surface. In addition, the structure may be preloaded, as illustrated in FIG. 7, by the application of a composite layer 92 which may be wound around the surface of the structure while a vacuum is established in the interior of the structure. After the overwrapping and curing thereof, the vacuum would be released resulting in a pre-loading of the spherical structure to ensure that the assembly remains in compression during handling outside of the water environment. If desired, the protective membrane 90 may be applied over the composite layer 92.

Figure 5:
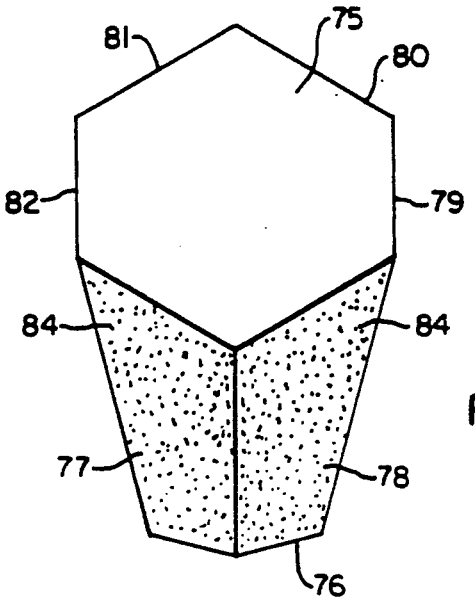
FIG. 5 is a view of one segment of such structure.
Figure 8:
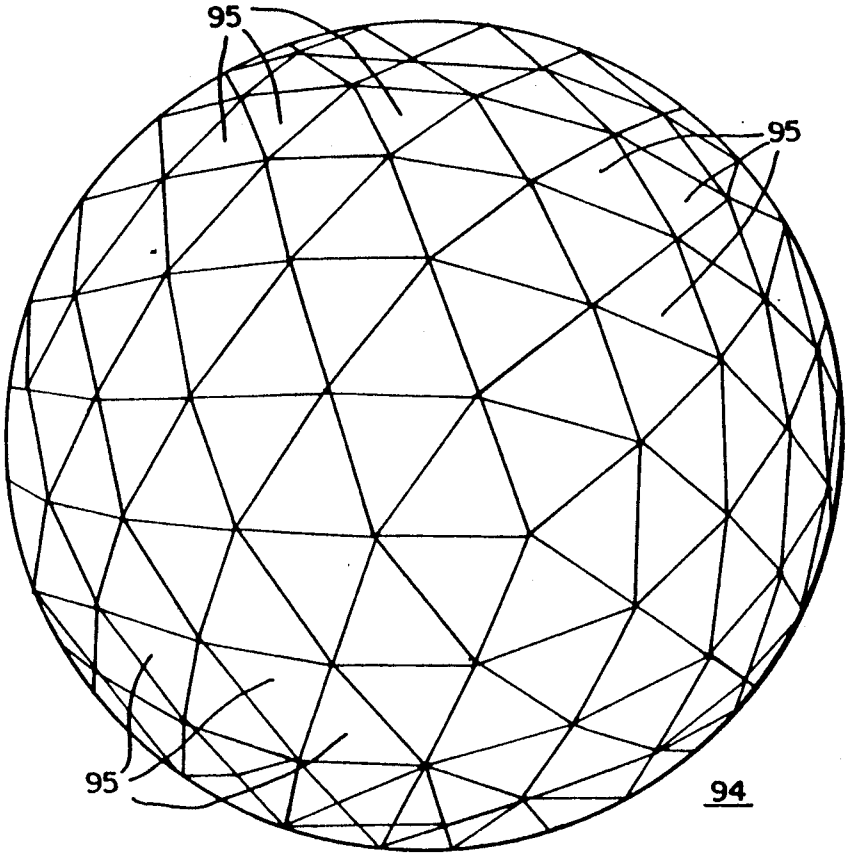
FIG. 8 illustrates a sphere formed from triangular segments.

A hexagonal segment has been illustrated in FIG. 5 for construction of the spherical structure illustrated in FIG. 6. It is obvious that other polygons or a combination of polygons may be used having greater or fewer sides. By way of example, FIG. 8 illustrates a spherical structure 94 constructed of triangular segments 95.

Figure 9:
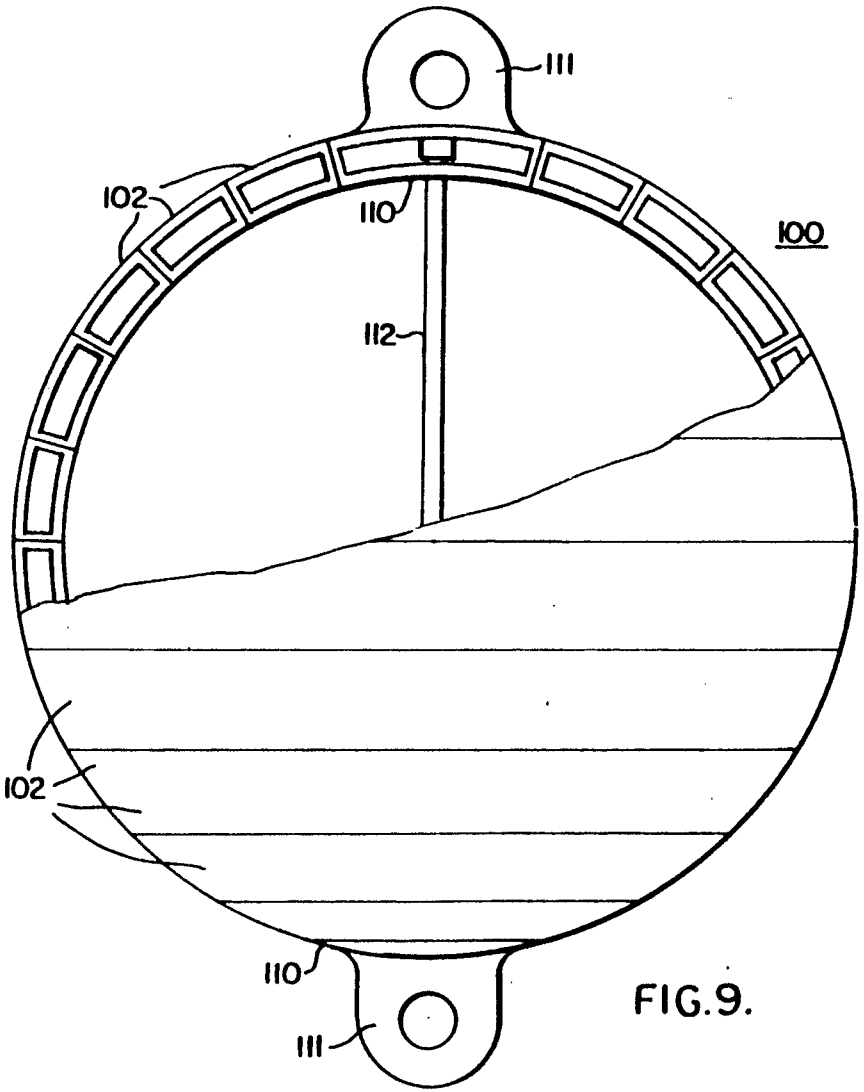
FIG. 9 illustrates, with a portion broken away, a sphere formed of toroidal segments.
Figure 10:
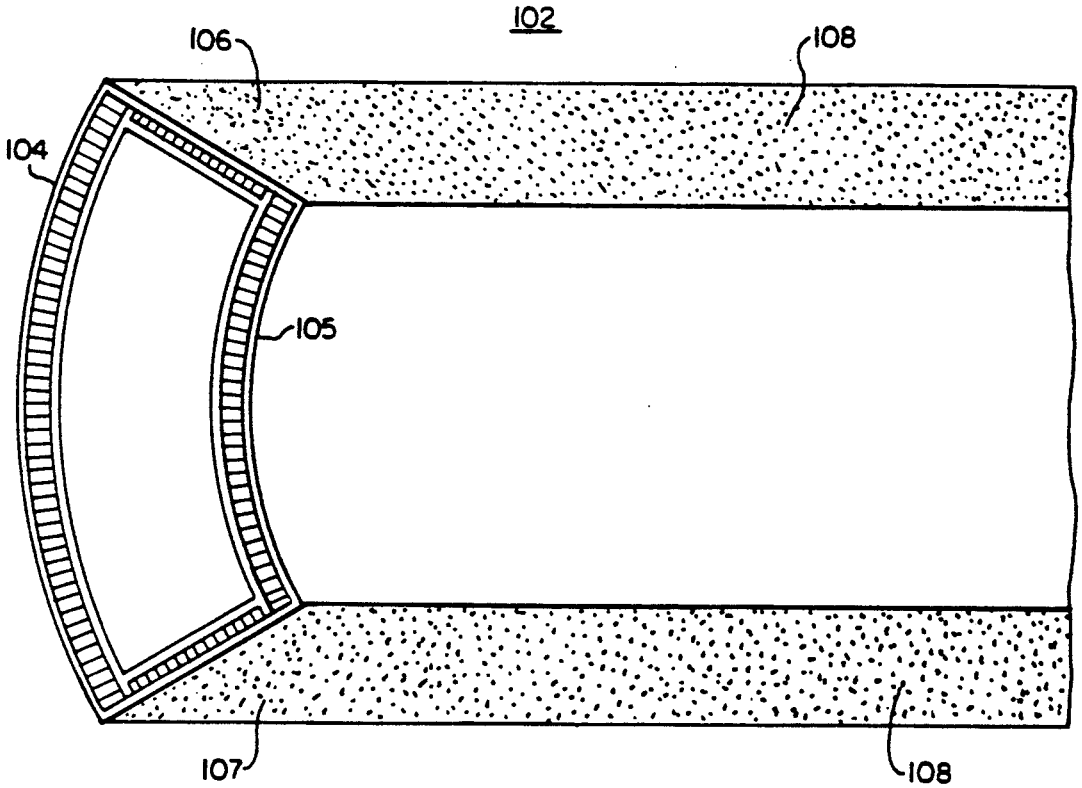
FIG. 10 is a cross-sectional view through one of the toroidal segments of FIG. 9.

FIG. 9 illustrates an alternate embodiment of the present invention wherein a spherical structure 100 is assembled from a plurality of toroidal segments 102 of varying shapes and sizes with each constructed in accordance with the teachings of the present invention. By way of example, with additional reference to FIG. 10, illustrating a typical toroidal segment 102, the segment includes outer and inner walls 104 and 105 joined by first and second tapered side walls 106 and 107. The walls illustrated in FIG. 10 are of identical construction to the walls illustrated in FIG. 3, however, the outer and inner walls 104 and 105 are illustrated as being curved to conform to the spherical surface, although the surfaces may be planar resulting in a faceted spherical surface.

As was the case with the previously described circular structures, the tori with varying diameters are joined together by a bonding material such as epoxy 108 applied to the side walls 106 and 107 of adjacent toroidal segments. The structure is completed with the provision of two keystone segments 110 having attachment means 111 and joined together by central rod 112 (FIG. 9).

Figure 11:
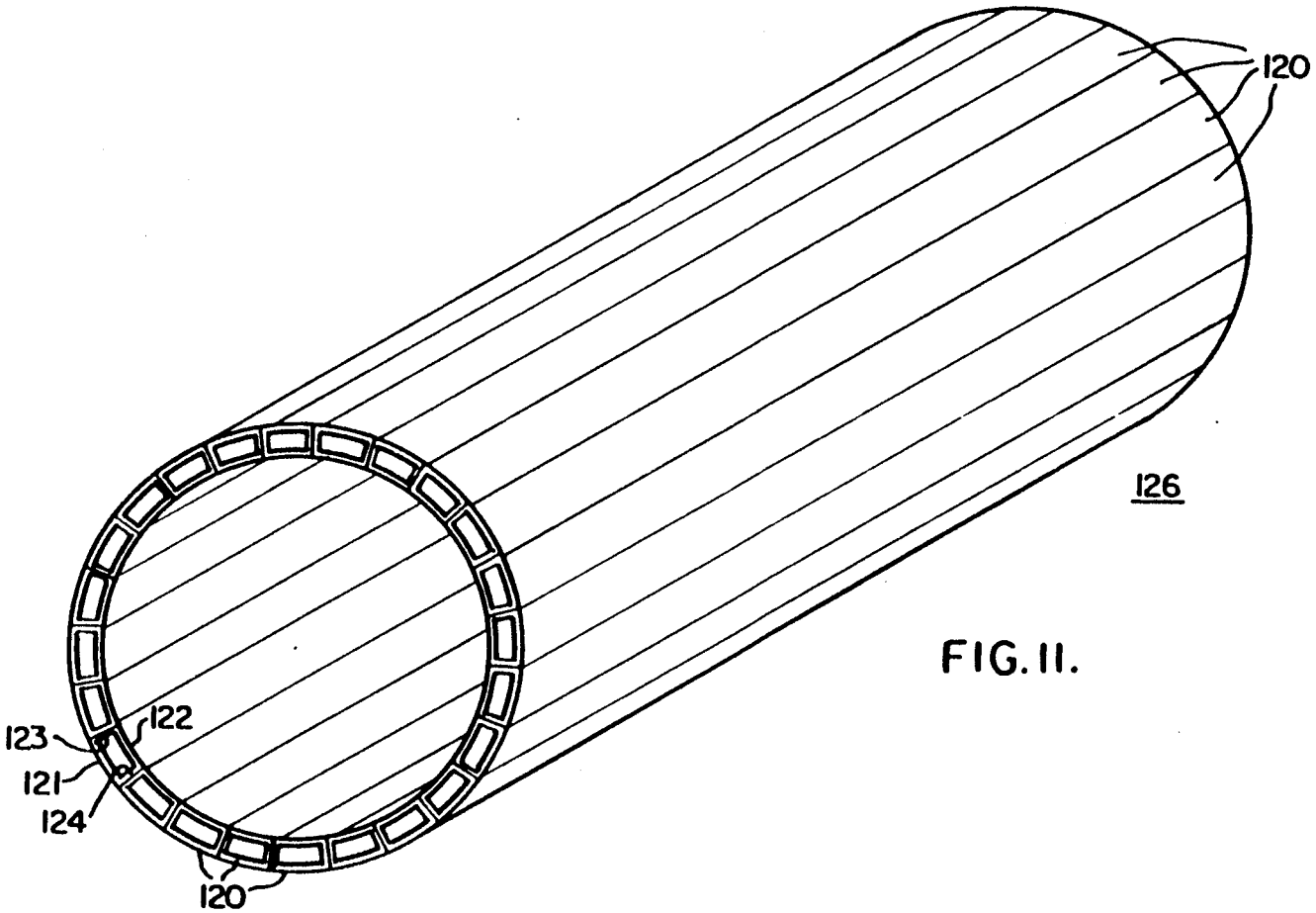
FIG. 11 illustrates a plurality of segments forming a cylindrical structure.

In FIG. 11, a plurality of elongated segments 120 each having outer wall 121, and an inner wall 122, joined by respective tapered side walls 123 and 124 are all adhesively joined together to form a hollow cylindrical structure 126. The individual elongated segments 120 may be formed by pultrusion techniques or may be assembled as individual wall members as in FIGS. 3 or 10.

Figure 12:
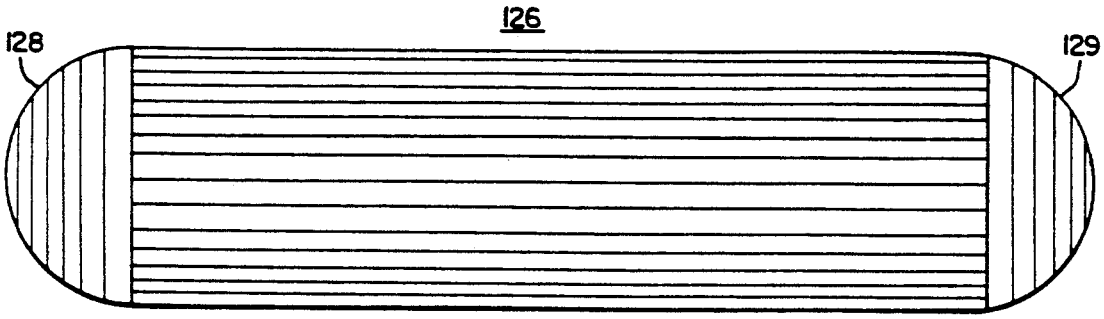
FIG. 12 illustrates a structure which may be utilized as an underwater submersible constructed in accordance with the present invention.

FIG. 12 illustrates one use for the hollow cylindrical structure 126. By affixing first and second hemispherical end sections 128 and 129 to respective ends of the cylindrical structure 126, the basic structure of an underwater vehicle is provided. Hemispherical end sections 128 and 129 may be fabricated by any one of the techniques described herein for spherical structures resulting in a vehicle which is relatively lightweight and can withstand the elevated pressures encountered at deep ocean depths. Although not illustrated, access apertures and propulsion equipment would be added to the structure in accordance with well known techniques.

I claim:

1. A composite, multisection positively buoyant structure, comprising:

a) a plurality of individual segments each including an outer wall, an inner wall spaced from said outer wall, and tapered side walls joining said outer and inner walls to define a central core;

b) at least said outer and inner walls each including at least first and second opposed face members separated by a filler material;

c) means bonding said tapered side walls of said individual segments together in a predetermined geometric pattern to form said buoyant structure.

2. A structure according to claim 1 wherein:

a) said face members are comprised of a composite material.

3. A structure according to claim 1 wherein:

a) said filler material is of a honeycomb construction.

4. A structure according to claim 1 wherein:

a) each said tapered side walls includes at least first and second opposed face members separated by a filler material.

5. A structure according to claim 1 wherein:

a) the outer surface of said segments defines a polygon.

6. A structure according to claim 5 wherein:

a) said segments are bonded together and arranged to form a spherical structure.

7. A structure according to claim 6 which includes:

a) an attachment means forming a part of said structure.

8. A structure according to claim 7 which includes:

a) a keystone segment having tapered side walls bonded to adjacent ones of said segments;

b) said attachment means being connected to said keystone segment.

9. A structure according to claim 8 wherein:

a) said keystone segment includes an outer wall, an inner wall spaced from said outer wall, and tapered side walls joining said outer and inner walls to define a central core.

10. A structure according to claim 8 which includes:

a) an additional keystone segment diametrically positioned from said first mentioned keystone segment.

11. A structure according to claim 10 which includes:

a) a tension rod connecting both said keystone segments and passing through the center of said structure.

12. A structure according to claim 1 wherein:

a) said segments are in the form of tori of varying diameters;

b) said diameters being so selected and said tori being arranged to form a spherical structure.

13. A structure according to claim 1 wherein:

a) said segments are elongated, b) said segments are arranged to form a cylindrical structure.

14. A structure according to claim 13 which includes:

a) first and second hemispherical end sections respectively connected to the ends of said cylindrical structure.

15. A structure according to claim 1 which includes:

a) a protective membrane covering the outer surface of said structure and exposed to the ambient medium.

* * * * *